US009363587B2

(12) United States Patent
Weiss et al.

(10) Patent No.: US 9,363,587 B2
(45) Date of Patent: Jun. 7, 2016

(54) PRESSURE VENT FOR SPEAKER OR MICROPHONE MODULES

(71) Applicant: Apple Inc., Cupertino, CA (US)

(72) Inventors: Samuel Weiss, Menlo Park, CA (US); David M. Pelletier, Cupertino, CA (US); Jesse A. Lippert, Sunnyvale, CA (US); Nikolas T. Vitt, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/097,833

(22) Filed: Dec. 5, 2013

(65) Prior Publication Data

US 2015/0163572 A1 Jun. 11, 2015

(51) Int. Cl.

*H04R 1/08* (2006.01)
*H04R 1/02* (2006.01)
*H04R 1/28* (2006.01)

(Continued)

(52) U.S. Cl.

CPC ..... *H04R 1/02* (2013.01); *H04R 1/2876* (2013.01); *H04R 29/001* (2013.01); *H04R 1/44* (2013.01); *H04R 2307/025* (2013.01); *H04R 2499/11* (2013.01)

(58) Field of Classification Search

CPC ..... H04R 1/08; H04R 9/08; H04R 11/04; H04R 17/02; H04R 21/02; H04R 1/02; H04R 1/105; H04R 9/00

USPC ..... 381/355, 357, 358, 360, 361, 369, 396, 381/334

See application file for complete search history.

(56) References Cited

U.S. PATENT DOCUMENTS 2,778,882 A * 1/1957 Pontzen ..... H04R 1/38 338/22 SD
3,895,194 A * 7/1975 Fraim ..... H04R 1/04 381/113
4,646,872 A 3/1987 Kamon et al.

(Continued)

FOREIGN PATENT DOCUMENTS

CN 101485211 7/2009
CN 102611976 7/2012

(Continued)

OTHER PUBLICATIONS

Invitation to Pay Additional Fees and Partial Search Report dated Dec. 23, 2014, PCT/US2014/060831, 7 pages.

(Continued)

*Primary Examiner* — Suhan Ni
(74) *Attorney, Agent, or Firm* — Brownstein Hyatt Farber Schreck, LLP

(57) ABSTRACT

A speaker or microphone module includes an acoustic membrane and at least one pressure vent. The pressure vent equalizes barometric pressure on a first side of the acoustic membrane with barometric pressure on a second side of the acoustic membrane. Further, the pressure vent is located in an acoustic path of the speaker or microphone module. In this way, differences between barometric pressures on the different sides of the acoustic membrane may not hinder movement of the acoustic membrane. In one or more implementations, the pressure vent may be acoustically opaque. As the pressure vent is located in the acoustic path of the speaker or microphone module, being acoustically opaque may ensure that the pressure vent itself does not interfere with the operation of the speaker or microphone module.

20 Claims, 5 Drawing Sheets

(51) Int. Cl.
*H04R 29/00* (2006.01)
*H04R 1/44* (2006.01)

(56) References Cited

U.S. PATENT DOCUMENTS

| | | | | |
|---|---|---|---|---|
| 6,018,585 | A * | 1/2000 | Akino et al. | 381/355 |
| 6,188,773 | B1 * | 2/2001 | Murata et al. | 381/361 |
| 6,275,594 | B1 * | 8/2001 | Senoo et al. | 381/114 |
| 6,648,750 | B1 * | 11/2003 | Wiseman | 381/71.5 |
| 7,433,484 | B2 * | 10/2008 | Asseily | H04R 1/342 381/322 |
| 8,126,138 | B2 | 2/2012 | Dinh et al. | |
| 8,502,664 | B2 | 8/2013 | Yoshida et al. | |
| 8,520,868 | B2 | 8/2013 | Jeong et al. | |
| 9,098,992 | B2 | 8/2015 | Sekiyama | |
| 2003/0123692 | A1 | 7/2003 | Ueki | |
| 2005/0079832 | A1 | 4/2005 | Gelbart et al. | |
| 2012/0128190 | A1 | 5/2012 | Tam | |
| 2012/0202559 | A1 * | 8/2012 | Shiogama | H04R 1/021 381/386 |

FOREIGN PATENT DOCUMENTS

| | | |
|---|---|---|
| CN | 102655621 | 9/2012 |
| CN | 202873045 | 4/2013 |
| DE | 102007014365 | 10/2008 |
| DE | 112006000463 | 2/2012 |
| JP | H1127781 | 1/1999 |
| JP | H11331967 | 11/1999 |
| JP | 2000 201388 | 7/2000 |
| JP | 2005012644 | 1/2005 |
| JP | 2013 115549 | 6/2013 |
| WO | WO 2004/043113 | 5/2004 |

OTHER PUBLICATIONS

International Search Report and Written Opinion dated Feb. 20, 2015, PCT/US2014/060831, 17 pages.

Evaluation Report dated May 29, 2915, Chinese Patent Application No. ZL20140733843.1, 6 pages.

* cited by examiner

PRESSURE VENT FOR SPEAKER OR MICROPHONE MODULES

TECHNICAL FIELD

This disclosure relates generally to speakers or microphones, and more specifically to pressure vents for speaker or microphone modules.

BACKGROUND

Many speakers, such as speaker modules, produce sound waves by vibrating an acoustic membrane. For example, electromagnetic speakers generate magnetic flux utilizing center and side magnets. Such magnetic flux moves a voice coil that is coupled to an acoustic membrane, thus vibrating the acoustic membrane and producing sound waves.

However, such speakers may not function correctly if movement of the acoustic membrane is hindered. For example, liquid or other substances may enter the speaker and hinder movement of the acoustic membrane.

Further, such movement may be hindered by differences in barometric pressure. If the difference between the barometric pressure on an external side of the acoustic membrane and the barometric pressure on an internal side of the acoustic membrane is too great, the acoustic membrane may be deformed and/or may not be able to expand in order to vibrate appropriately.

Regardless, if movement of the acoustic membrane is hindered, the speaker may not be able to produce sound waves as intended. This may result in distorted sound output. Such distortion may continue until the barometric pressure on the external side of the acoustic membrane is equalized with the barometric pressure on the internal side of the acoustic membrane.

Similarly, many microphones or microphone modules, detect sound waves by monitoring output of a voice coil coupled to an acoustic membrane that is vibrated by sound waves. Hindering of the acoustic membrane of such a microphone may cause distortion in the detected sound waves for similar reasons to those already discussed.

SUMMARY

The present disclosure discloses apparatuses, systems, and methods for venting pressure of a speaker or microphone module.

The present disclosure discloses apparatuses, systems, and methods for venting pressure of a speaker or microphone module. A speaker or microphone module may include an acoustic membrane and at least one pressure vent. The pressure vent may equalize barometric pressure on a first side of the acoustic membrane with barometric pressure on a second side of the acoustic membrane. Further, the pressure vent may be located in an acoustic path of the speaker or microphone module. In this way, differences between barometric pressures on the different sides of the acoustic membrane may not hinder movement of the acoustic membrane. In one or more implementations, the pressure vent may be acoustically opaque. As the pressure vent is located in the acoustic path of the speaker or microphone module, being acoustically opaque may ensure that the pressure vent itself does not interfere with the operation of the speaker or microphone module.

In various implementations, the pressure vent may be a pressure vent membrane coupled to a surface of the speaker or microphone module. Such a membrane may be formed of polytetrafluoroethylene (PTFE), expanded polytetrafluoroethylene (ePTFE), and/or other such material. The membrane may allow air to pass but may prevent the passage of water and/or water vapor. In some instances, the membrane may be adhered to the surface utilizing adhesive. In other implementations, the pressure vent may be other kinds of pressure vent. For example, in some implementations the pressure vent may include a number of sintered metal discs.

The speaker or microphone module may be incorporated into the housing of a device and the pressure vent may vent into an internal volume of the housing and/or the speaker or microphone module. In such cases, a back of the speaker or microphone module may face the internal volume of the housing.

In various cases, the speaker or microphone module may be a waterproof (i.e., waterproof and/or water resistant up to a particular depth such as thirty meters) speaker or microphone module. In such cases, the acoustic membrane may be a waterproof acoustic membrane formed of rubber, polymer, and/or other such elastic waterproof material.

In some cases, the surface of the speaker or microphone module may be a top cover that is separated from the acoustic membrane by a cavity. One or more portions of such a cavity may be coated (such as via vapor deposition) with a hydrophobic coating.

In some implementations, the speaker or microphone module may include a cavity adjacent to the acoustic membrane. Liquid and/or other such material that may adversely impact movement of the acoustic membrane and/or operation of the speaker or microphone module may become present in the cavity. As such, the speaker or microphone module may be capable of determining that liquid is present in the cavity and attempting to drive the liquid from the cavity by producing one or more tones or pulses. The speaker module may then be capable of determining whether or not the liquid is still present in the cavity after producing the tones. If so, the speaker or microphone module may be capable of further attempting to drive the liquid from the cavity by producing one or more modified tones or pulses.

In various implementations, a speaker or microphone module includes an acoustic membrane and at least one pressure vent that equalizes pressure on a first side of the acoustic membrane with pressure on a second side of the acoustic membrane. The at least one pressure vent is located in an acoustic path of the speaker or microphone module.

In some implementations, a method for venting pressure of a speaker module or microphone includes: coupling an acoustic membrane in a speaker or microphone module; including at least one pressure vent in the speaker or microphone module; and locating the at least one pressure vent in an acoustic path of the speaker or microphone module.

In one or more implementations, a system for venting pressure of a speaker or microphone includes a device including a housing and a speaker or microphone module coupled to the housing. The speaker or microphone module includes an acoustic membrane and at least one pressure vent that equalizes pressure on a first side of the acoustic membrane with pressure on a second side of the acoustic membrane. The at least one pressure vent is located in an acoustic path of the speaker or microphone module.

It is to be understood that both the foregoing general description and the following detailed description are for purposes of example and explanation and do not necessarily limit the present disclosure. The accompanying drawings, which are incorporated in and constitute a part of the specification, illustrate subject matter of the disclosure. Together, the descriptions and the drawings serve to explain the principles of the disclosure.

DETAILED DESCRIPTION

Figure 1:
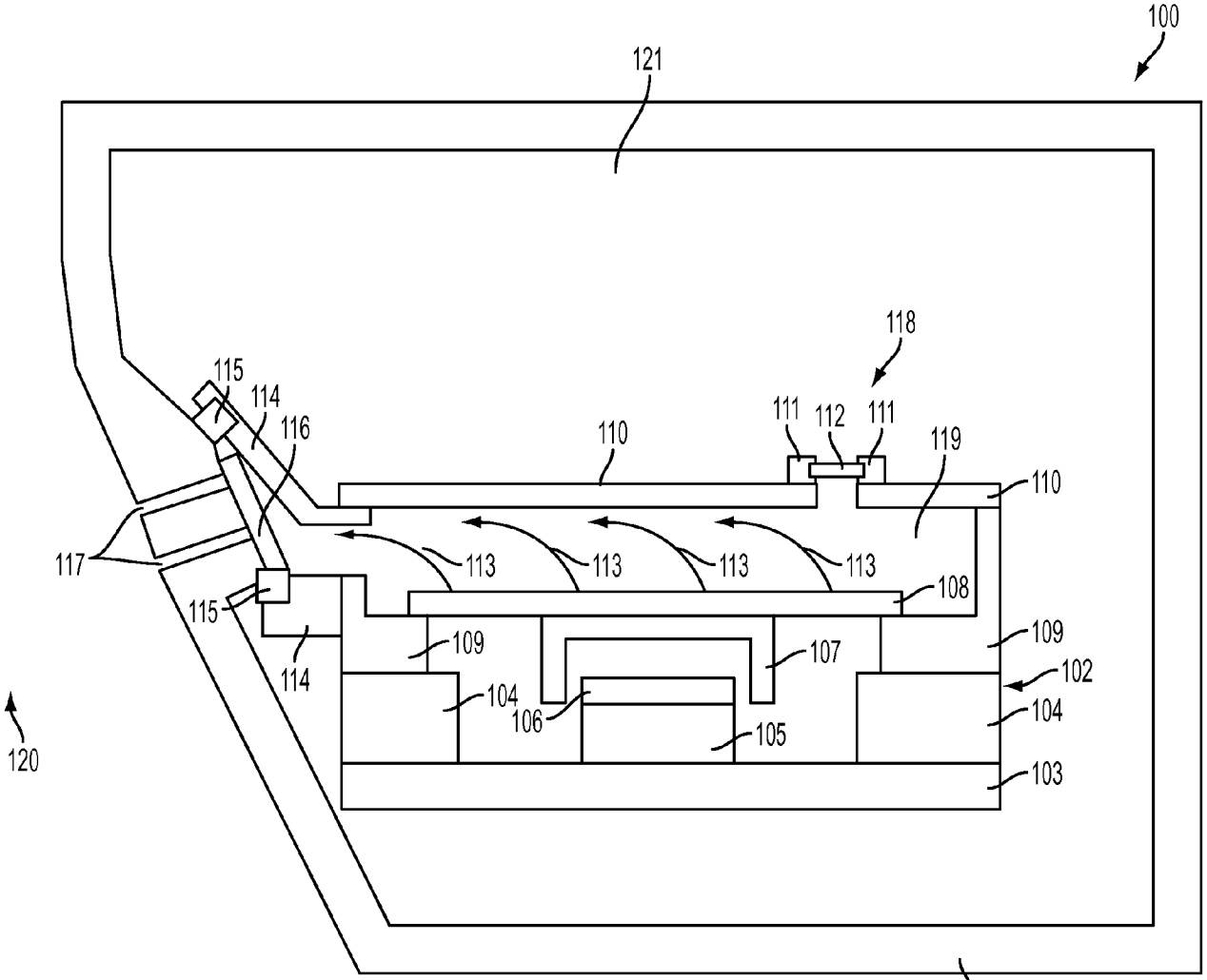
FIG. 1 is a cross-sectional side view of a system for venting pressure of a speaker module.

The description that follows includes sample systems, methods, and computer program products that embody various elements of the present disclosure. However, it should be understood that the described disclosure may be practiced in a variety of forms in addition to those described herein.

The present disclosure discloses apparatuses, systems, and methods for venting pressure of a speaker or microphone module. A speaker or microphone module may include an acoustic membrane and at least one pressure vent. The pressure vent may equalize barometric pressure on a first side (such as an external side) of the acoustic membrane with barometric pressure on a second side (such as an internal side) of the acoustic membrane. Further, the pressure vent may be located in an acoustic path of the speaker or microphone module. In this way, differences between barometric pressures on the different sides of the acoustic membrane may not hinder movement of the acoustic membrane. As a result, operation of the speaker or microphone module may not be adversely impacted by barometric pressures.

In one or more implementations, the pressure vent may be acoustically opaque. As the pressure vent is located in the acoustic path of the speaker or microphone module, being acoustically opaque may ensure that the pressure vent itself does not interfere with the operation of the speaker or microphone module.

In various implementations, the pressure vent may be a pressure vent membrane coupled to a surface of the speaker or microphone module. Such a membrane may be formed of polytetrafluoroethylene (PTFE), expanded polytetrafluoroethylene (ePTFE), and/or other such material. The membrane may allow air to pass but may prevent the passage of water and/or water vapor. In some instances, the membrane may be adhered to the surface utilizing adhesive.

In other implementations, the pressure vent may be other kinds of pressure vent. For example, in some implementations the pressure vent may include a number of sintered metal discs.

In some cases, the surface of the speaker or microphone module may be a top cover that is separated from the acoustic membrane by a cavity. One or more portions of such a cavity may be coated (such as via vapor deposition) with a hydrophobic coating.

The speaker or microphone module may be incorporated into the housing of a device and the pressure vent may vent into an internal volume of the housing and/or the speaker module. In such cases, a back of the speaker or microphone module may face the internal volume of the housing.

In various cases, the speaker or microphone module may be a waterproof (i.e., waterproof and/or water resistant up to a particular depth such as thirty meters) speaker or microphone module. In such cases, the acoustic membrane may be a waterproof acoustic membrane formed of rubber, polymer, and/or other such elastic waterproof material.

In some implementations, the speaker or microphone module may include a cavity adjacent to the acoustic membrane. Liquid and/or other such material that may adversely impact movement of the acoustic membrane and/or operation of the speaker or microphone module may become present in the cavity. As such, the speaker or microphone module may be capable of determining that liquid is present in the cavity and attempting to drive the liquid from the cavity by producing one or more tones or pulses. The speaker or microphone module may then be capable of determining whether or not the liquid is still present in the cavity after producing the tones. If so, the speaker or microphone module may be capable of further attempting to drive the liquid from the cavity by producing one or more modified tones or pulses.

FIG. 1 is a cross-sectional side view of a system 100 for venting pressure of a speaker module 102. As illustrated, the speaker module may be incorporated into the housing 101 of a device. The device may be any kind of device such as a laptop computer, a desktop computer, a mobile computer, a tablet computer, a cellular telephone, a smart phone, a digital media player, a wearable device, and/or any other device that includes a speaker module.

The housing 101 may include an internal volume 121. The housing may also include one or more apertures 117 that may be covered by a mesh 116 and/or other covering structure. Though the mesh is illustrated as positioned on an internal portion of the apertures, it is understood that this is an example. In various cases, the mesh may be positioned on an exterior surface of the housing and/or a mesh may not be utilized.

The speaker module 102 may include coupling elements 114. The speaker module may be positioned in the internal volume 121 and coupled to an interior surface of the housing around the apertures 117 by the coupling elements via one or more o-rings 115.

Figure 2:
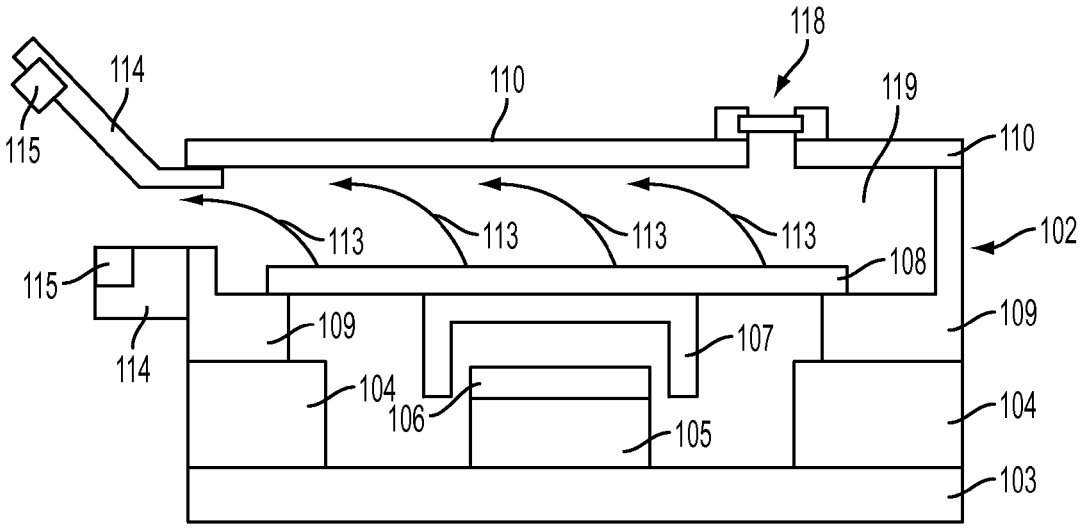
FIG. 2 is a cross-sectional side view of the speaker module of FIG. 1.

FIG. 2 is a cross-sectional side view of the speaker module 102 of FIG. 1 with the housing 101 removed.

Returning to FIG. 1, the speaker module 102 may include an acoustic membrane 108. In some cases, the speaker module may be a waterproof speaker module and the acoustic membrane may be formed of rubber, polymer, and/or other such elastic waterproof material. The speaker module may be operable to vibrate and/or move the acoustic membrane in order to produce sound waves. The speaker module may also include a barometric pressure vent 118.

As illustrated, the pressure vent 118 may be located on a top cover 110 that is separated from the acoustic membrane 108 by a cavity 119. As such, the pressure vent may vent into the internal volume 121 of the housing 101. As illustrated, the other end of the speaker module 102 is also located in the internal volume of the housing. Thus, by venting into the internal volume the pressure vent may cause the barometric pressure on both sides of the acoustic membrane to equalize. This may prevent barometric pressure differences between the two sides from deforming the acoustic membrane inward or outwards or preventing the acoustic membrane from expanding and thus hindering operating of the speaker module. In some cases, the top cover may be formed of steel.

The speaker module 102 may have one or more acoustic paths 113. As illustrated, sound waves produced by the acoustic membrane 108 may travel toward the top cover 110 and then toward the mesh 116, through the apertures 117, and out into an environment 120 external to the housing 101. As such, the pressure vent 118 may be located in an acoustic path of the speaker module. However, the pressure vent may be acoustically opaque such that the pressure vent does not interfere with the operation of the speaker module.

In some cases, the speaker module 102 may have one or more locations with a pressure null at the resonance frequency of the acoustic path 113. In such cases, the pressure vent 118 may be located at such a pressure null location. This may improve part-to-part variability and distortion at the front port resonance.

In various cases, the pressure vent 118 may be placed away from the excursion of the acoustic membrane 108. This may prevent the acoustic membrane from rubbing against the pressure vent when the vent and/or the acoustic membrane are stretched due to high hydrostatic loads.

As illustrated, the pressure vent 118 may be a pressure vent membrane 112 coupled to the top cover 110 by adhesive 111 and/or other coupling mechanism. Such a pressure vent membrane may be formed of PTFE, ePTFE, and/or other such material. The pressure vent membrane may allow air to pass but may prevent the passage of water and/or water vapor thus enabling pressure on both sides of the acoustic membrane 108 to equalize.

The larger the pores of the pressure vent membrane 112, the more air that the membrane may allow to pass (thus providing superior venting). However, larger pores may be more susceptible to the passage of water and/or water vapor. Similarly, the larger the size of the pressure vent membrane, the more air that the pressure vent membrane may allow to pass (thus also providing superior venting). However, increasing the size of the pressure vent membrane may not make the membrane more pervious to water and/or water vapor. However, only a certain amount of area of the speaker module 102 may be available for the pressure vent membrane. As such, the size of the pressure vent membrane and the size of the pores of the pressure vent membrane may selected based on available area, the amount of venting that may be needed, and the resistance needed to water and/or water vapor.

In some cases, one or more portions of the cavity 119 may be coated with a hydrophobic coating. Such a coasting may enable any water that enters the cavity to exit as quickly as possible. In some cases, such a coating may be applied by a process such as a vapor deposition process. For example, the coating may be vapor deposited on the walls of the cavity (including the top cover 110) before the pressure vent membrane 112 is adhesively attached.

As illustrated, the speaker module 102 may be an electromagnetic speaker. Such a module may include sidewalls 109, voice coil 107 coupled to the acoustic membrane 108, side magnets 104, center magnet 105 including top plate 106, yoke 103, and/or other electromagnetic speaker components. The side magnets, yoke, and center magnets may be electrically controllable to produce magnetic flux. Polarities of the side magnets and center magnet may be opposed such that the magnetic flux cases the voice coil to move, thus vibrating the acoustic membrane 108. However, it is understood that this is an example. In various implementations, the speaker module may be any kind of speaker module and the present disclosure is not limited to electromagnetic speakers.

Although the system 100 is illustrated and described above as locating the pressure vent 118 on the top cover 110, it is understood that this is an example. In various implementations, the pressure vent may be located on the coupling element 114, the sidewalls 109, the acoustic membrane 108, and/or any other component of the speaker module 102 without departing from the scope of the present disclosure.

Further, although the pressure vent 118 is illustrated and described above as venting into the internal volume 121, it is understood that this is an example. In various implementations, the pressure vent may vent into an internal volume of the speaker module without departing from the scope of the present disclosure.

Additionally, although the pressure vent 118 is illustrated as a pressure vent membrane 112, it is understood that this is an example. In various implementations, the pressure vent may be any kind of mechanism for venting pressure and may or may not restrict the passage of water and/or water vapor.

Figure 3:
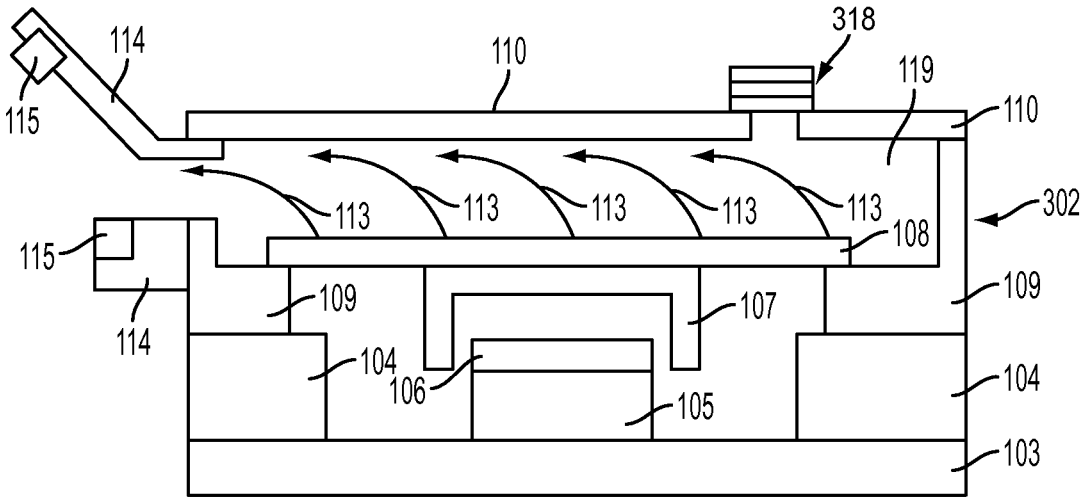
FIG. 3 is a cross-sectional side view of an alternative embodiment of a speaker module.

For example, FIG. 3 is a cross-sectional side view of an alternative embodiment of a speaker module 302. As contrasted with FIG. 2, the speaker module 302 may include a barometric pressure vent 318 that includes a plurality of sintered metal discs. Absent pressure, the sintered metal discs may be in a collapsed position such that a path is not formed through one or more holes in the sintered metal discus. However, under pressure, the sintered metal discs may expand to one or more expanded positions such that a path is formed through the holes that is operable to release the pressure. In some cases, the hole(s) in a particular disc may be misaligned (such as at 90 degrees) with an adjacent disc.

Figure 4:
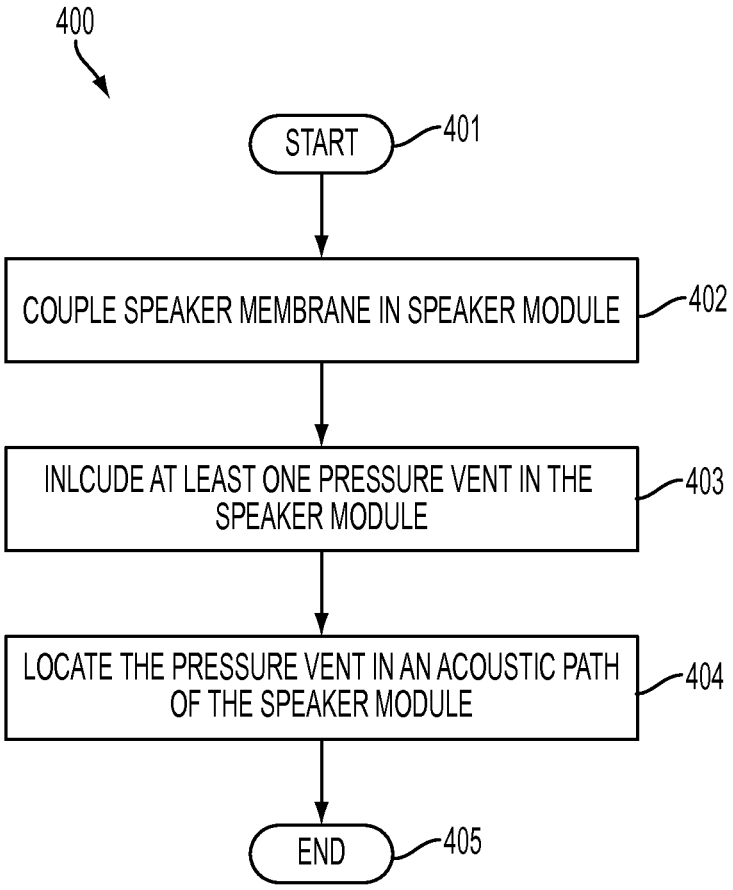
FIG. 4 is a flow chart illustrating a method for venting pressure of a speaker module. This method may be performed by the system of FIG. 1. and/or the speaker modules of FIGS. 2-3.

FIG. 4 is a flow chart illustrating a method 400 for venting pressure of a speaker module. This method may be performed by the system 100 of FIG. 1. and/or the speaker modules 102 and 302 of FIGS. 2-3.

The flow may begin at block 401 and proceed to block 402 where an acoustic membrane (or "speaker membrane") is coupled into a speaker module. The flow may then proceed to block 403 where at least one pressure vent is included in the speaker module. Next, the flow may proceed to block 404 where the pressure vent may be located in an acoustic path of the speaker module.

The flow may next proceed to block 405 and end.

Although the method 400 is illustrated and described above as including a particular configuration of operations performed in a particular order, it is understood that this is an example. In various implementations, various arrangements of the same, similar, and/or different operations may be performed.

For example, operations 403 and 404 are illustrated as consecutive, linear operations. However, in various implementations the two operations may be performed simultaneously and/or otherwise in parallel.

Returning to FIG. 1, in some instances, liquid and/or other such material that may adversely impact movement of the acoustic membrane 108 and/or operation of the speaker module 102 may become present in the cavity 119. In such instances, the liquid may need to be expelled from the cavity in order to return the speaker to appropriate operation.

In some implementations, the speaker module 102 and/or a device in which the speaker module is incorporated may be capable of determining that liquid is present in the cavity. For example, a microphone (not shown) may be included in the speaker module and/or the device. The microphone may be utilized to measure acoustic output of the speaker module. If the acoustic output does not match the expected output of the speaker module, the speaker module and/or the device may assume that liquid is present in the cavity 119 and is interfering with operation.

As such, the speaker module 102 and/or the device may attempt to drive the liquid from the cavity 119 by producing one or more tones or pulses utilizing the acoustic membrane 108. Such tones or pulses may force the liquid out of the cavity, through the mesh 116 and the apertures 117, and out into the environment 120 external to the housing 101.

However, in some cases, the tones or pulses may not be sufficient to drive the liquid from the cavity 119. After producing such tones or pulses, the speaker module 102 and/or the device may determine whether or not the liquid is still present in the cavity. Such a determination may be made similarly to how the speaker module or device first determine that the liquid was present in the cavity.

If the liquid is still present in the cavity 119, the speaker module 102 and/or the device may attempt to drive the liquid from the cavity by producing one or more modified tones or pulses. By repeatedly using tones or pulses to attempt to drive out the liquid and then determining whether or not the operation was successful, tones or pulses that will successfully clear the cavity may be produced even though various other tones or pulses that were not sufficient to clear the cavity were unsuccessful.

Figure 5:
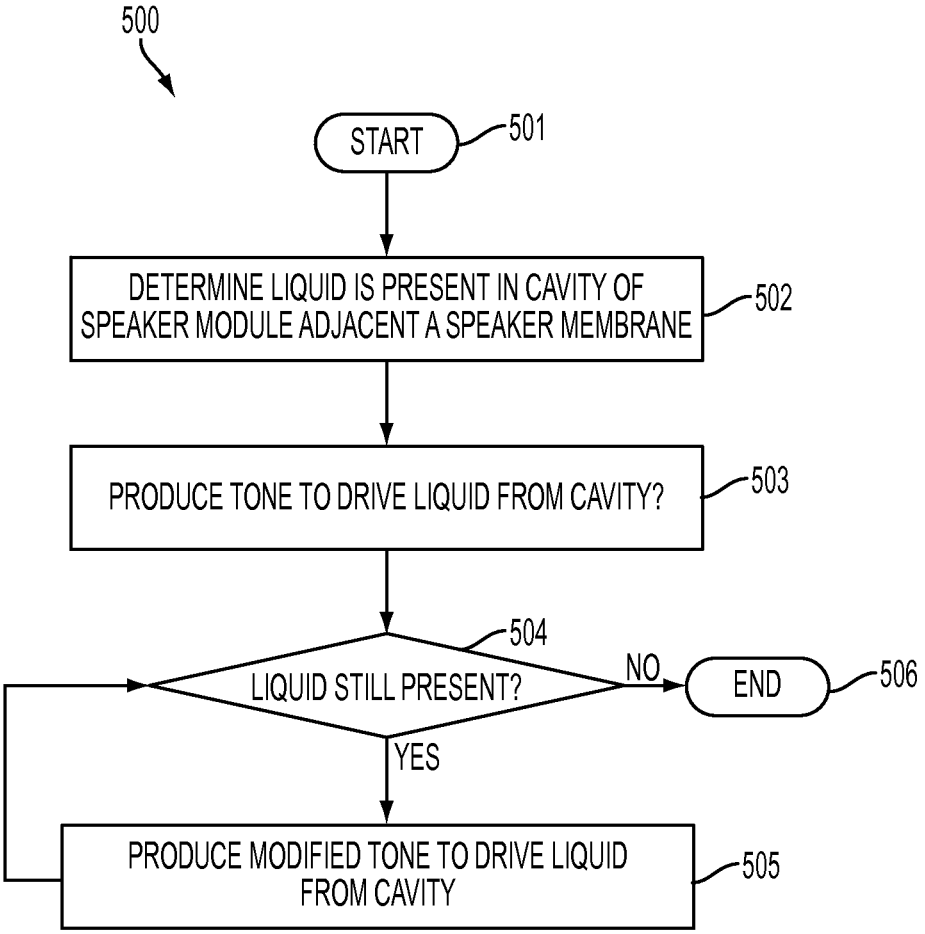
FIG. 5 is a flow chart illustrating a method for driving liquid from a speaker cavity. This method may be performed by the system of FIG. 1. and/or the speaker modules of FIGS. 2-3.

FIG. 5 is a flow chart illustrating a method 500 for driving liquid from a speaker cavity. This method may be performed by the system of FIG. 1. and/or the speaker modules of FIGS. 2-3.

The flow may begin at block 501 and proceed to block 502 where it is determined that liquid is present in a cavity of a speaker module adjacent to an acoustic membrane (or "speaker membrane"). The flow may then proceed to block 503 where one or more tones or pulses are produced to drive the liquid form the cavity. Next, the flow proceeds to block 504.

At block 504, it is determined whether or not the liquid is still present in the cavity. If so, the flow proceeds to block 505. Otherwise, the flow proceeds to block 506 and ends.

At block 505, after it is determined that the liquid is still present in the cavity, one or more modified tones or pulses are produced to drive the liquid from the cavity. The flow then returns to block 504 where it is determined whether or not the liquid is still present in the cavity.

Although the method 500 is illustrated and described above as including a particular configuration of operations performed in a particular order, it is understood that this is an example. In various implementations, various arrangements of the same, similar, and/or different operations may be performed.

For example, in some cases the method 500 may include an operation of modifying the tones or pulses produced in blocks 503 or 505. Such an operation may be positioned between blocks 504 and 505.

As discussed above and illustrated in the accompanying figures, the present disclosure discloses apparatuses, systems, and methods for venting pressure of a speaker module. A speaker module may include an acoustic membrane and at least one pressure vent. The pressure vent may equalize barometric pressure on a first side (such as an external side) of the acoustic membrane with barometric pressure on a second side (such as an internal side) of the acoustic membrane. Further, the pressure vent may be located in an acoustic path of the speaker module. In this way, differences between barometric pressures on the different sides of the acoustic membrane may not hinder movement of the acoustic membrane. As a result, operation of the speaker module may not be adversely impacted by barometric pressures.

Although the present disclosure illustrates and describes example speaker modules, it is understood that this is an example. A speaker module that monitors the output of a voice coil coupled to an acoustic membrane that is vibrated by sound waves may also utilize techniques discussed herein for venting pressure. The illustration and above discussion with respect to the example of a speaker module does not limit the scope of the present disclosure to not include microphones or microphone modules. The herein techniques may be applied to any acoustic module, or any module that operates acoustically such as a speaker or a microphone, without departing from the scope of the present disclosure.

In the present disclosure, the methods disclosed may be implemented as sets of instructions or software readable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

The described disclosure may be provided as a computer program product, or software, that may include a non-transitory machine-readable medium having stored thereon instructions, which may be used to program a computer system (or other electronic devices) to perform a process according to the present disclosure. A non-transitory machine-readable medium includes any mechanism for storing information in a form (e.g., software, processing application) readable by a machine (e.g., a computer). The non-transitory machine-readable medium may take the form of, but is not limited to, a magnetic storage medium (e.g., floppy diskette, video cassette, and so on); optical storage medium (e.g., CD-ROM); magneto-optical storage medium; read only memory (ROM); random access memory (RAM); erasable programmable memory (e.g., EPROM and EEPROM); flash memory; and so on.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context or particular embodiments. Functionality may be separated or combined in blocks differently in various embodiments of the disclosure or described with different terminology. These and other variations, modifications, additions, and improvements may fall within the scope of the disclosure as defined in the claims that follow.

We claim:

1. A speaker or microphone module, comprising:

an acoustic membrane that faces a cavity; and at least one pressure vent located in an acoustic path of the speaker or microphone module that equalizes pressure on a first side of the acoustic membrane with pressure on a second side of the acoustic membrane;

wherein the speaker or microphone module is operable to:

determine liquid is present in the cavity;

attempt to drive the liquid from the cavity by producing at least one tone;

determine the liquid is still present in the cavity after producing the at least one tone; and attempt to drive the liquid from the cavity by producing at least one modified tone.

2. The speaker or microphone module of claim 1, wherein the speaker or microphone module is a waterproof speaker module.

3. The speaker or microphone module of claim 1, wherein the at least one pressure vent is located on a top cover of the speaker that is separated from the acoustic membrane by the cavity.

4. The speaker or microphone module of claim 1, wherein at least a portion of the cavity is coated with a hydrophobic coating.

5. The speaker or microphone module of claim 1, wherein the acoustic path includes at least one turn.

6. The speaker or microphone module of claim 1, wherein the speaker or microphone module is incorporated into a housing of a device.

7. The speaker or microphone module of claim 6, wherein the at least one pressure vent vents into an internal volume of the housing of the device.

8. The speaker or microphone module of claim 7, wherein a back of the speaker or microphone module faces the internal volume of the housing of the device.

9. The speaker or microphone module of claim 1, wherein the at least one pressure vent comprises a pressure vent membrane.

10. The speaker or microphone module of claim 9, wherein the pressure vent membrane comprises expanded polytetrafluoroethylene.

11. The speaker or microphone module of claim 9, wherein the pressure vent membrane is adhesively bonded to the speaker or microphone module.

12. The speaker or microphone module of claim 1, wherein the acoustic membrane is a waterproof membrane.

13. The speaker or microphone module of claim 1, wherein the at least one pressure vent comprises a plurality of sintered metal discs.

14. The speaker or microphone module of claim 1, wherein the at least one pressure vent allows air to pass and prevents the passage of water.

15. The speaker or microphone module of claim 14, wherein the at least one pressure vent prevents the passage of water vapor.

16. The speaker or microphone module of claim 1, wherein the at least one pressure vent is acoustically opaque.

17. The speaker or microphone module of claim 1, wherein the at least one pressure vent vents into an internal volume of the speaker or microphone module.

18. A method for venting pressure of a speaker or microphone module, the method comprising:

coupling an acoustic membrane in a speaker or microphone module;

including at least one pressure vent in the speaker or microphone module;

locating the at least one pressure vent in an acoustic path of the speaker or microphone module; and configuring the speaker or microphone module to:

determine liquid is present in a cavity of the speaker or microphone module adjacent to the acoustic membrane;

produce at least one tone to drive the liquid from the cavity;

determine that the liquid is still present in the cavity; and produce at least one modified tone to drive the liquid from the cavity.

19. The method of claim 18, further comprising vapor depositing a hydrophobic coating on at least a portion of the cavity.

20. A system for venting pressure of a speaker or microphone module, comprising:

a device including a housing having an aperture; and a speaker or microphone module, coupled to the aperture, comprising:

a cavity;

an acoustic membrane positioned adjacent the cavity; and at least one pressure vent that equalizes pressure on a first side of the acoustic membrane with pressure on a second side of the acoustic membrane;

wherein the at least one pressure vent is located in an acoustic path of the speaker or microphone module; and wherein the device is configured to:

determine liquid is present in the cavity;

produce at least one tone;

determine the liquid is still present in the cavity after producing the at least one tone; and produce at least one modified tone.

* * * * *